United States Patent [19]

Maranghi

[11] 4,276,345

[45] Jun. 30, 1981

[54] METHOD FOR PREVENTING A SURFACE EXIT OF FIBERS FROM AN UNWOVEN FABRIC, THROUGH A VERY THIN LAYER OF EMULSIFIED LATEX, AND PRODUCT THEREBY OBTAINED

[75] Inventor: Marco Maranghi, Prato, Italy

[73] Assignee: Prato Commerz, S.p.A., Prato, Italy

[21] Appl. No.: 56,067

[22] Filed: Jul. 9, 1979

[51] Int. Cl.[3] ..... B05D 3/00; B32B 27/34

[52] U.S. Cl. ..... 428/284; 427/299; 427/301; 427/322; 427/412; 428/286; 428/287; 428/290; 428/332

[58] Field of Search ..... 428/284, 286, 287, 290, 428/332; 427/299, 301, 322, 412

[56] References Cited

U.S. PATENT DOCUMENTS 2,027,322 1/1936 Rice ..... 428/284

*Primary Examiner*—Marion McCamish

*Attorney, Agent, or Firm*—Bacon & Thomas

[57] ABSTRACT

A method for preventing surface exit of piles from a fabric through a very thin layer of spreading and product thereby obtained, wherein the base or support intended to be spread with acryl resins or butadiene-acrylonitrile in emulsion is previously imbued with emulsion destabilizers building up the coagulation of the emulsion as the resin contacts the fabric.

6 Claims, 3 Drawing Figures

Figure 1:
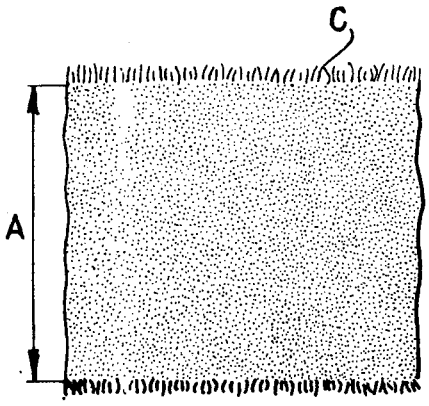

METHOD FOR PREVENTING A SURFACE EXIT OF FIBERS FROM AN UNWOVEN FABRIC, THROUGH A VERY THIN LAYER OF EMULSIFIED LATEX, AND PRODUCT THEREBY OBTAINED

This invention is concerned with a system for preventing the exit of piles in unwoven fabric on the external surface thereof, when said unwoven fabric has been covered with a very thin layer of emulsified latex, the thickness of which is adjustable by the present method, and the product thereby obtained.

The spreading of emulsifying resins on an unwoven fabric has the disadvantage of causing a hardening and stiffening of the obtained product.

When the emulsion layer thickness is too much reduced, by operating with the processes of the prior art, at the surface an exit of piles of the unwoven fabric is caused, since the spread emulsfied resin "dips" into the fabric which imbues it, and does not inhibit the passage of the fabric piles through the covering layer, with resulting residual surface hairiness. This is undesirable in many applications of such products, as for example in cleaning cloths.

In accordance with the method of the present invention, by previously impregnating the unwoven fabric with emulsion destabilizing substances, a surface blocking of the spread resin is built up, which avoids any further penetration of the resin into the fabric cavities or interstices, creating a barrier on the fabric hairiness stopping at the surface and preventing any penetration of the resin into the fabric cavities. At the same time, this imparts to the resulting product an increased softness, flexibility and draping, due to the reduced thickness of the spread layer and non-penetration of the resin inside the fabric.

It is known that resins comprising aqueous emulsified latices of the acryl or butadiene-acrylonitrile type are maintained in stable emulsion by soaps, surfactants and the like in alkaline environment.

When the chemical stability of the emulsion is modified, a coagulation of the resin is obtained.

According to the present invention, the base or support which is to be spread with emulsion is impregnated with substances destabilizing the same, and which are normally formed of electrolytes, such as solutions of sodium chloride, calcium chloride and aluminum sulphate. The base or support fabric is then imbued in a conventional "foulard" or squeezer, squeezed under a preset pressure so as to obtain the desired degree of residual moisture. Then drying is performed by known devices, such as drying tunnel or oven, rameuse, rollers and the like, removing the water contained in the solution. A fabric is provided as covered with fine salt crystals having a slight "boarded" appearance, on which the spreading step is performed.

The spreading paste comprises latices of butadiene-acrylonitrile type, which are usually thickened by known thickening agents, such as methyl cellulose, polyacrylic acids or the like, and maintained in aqueous emulsion by surfactants.

The emulsion spreading is effected by known techniques, such as blade, doctor, air blade, spray spreading and the like.

As soon as the emulsion paste contacts the surface of the fabric pretreated with a destabilizing agent, a surface coagulation occurs therein with resulting impossibility for the resin to further penetrate into the interior of the fabric.

Due to the impossibility of being further absorbed by the fabric, the resin slurry is surface blocked, building up a film which prevents the undesired exit of the fabric piles.

For a better understanding of the invention, the following drawing is enclosed, the figures of which show two of the tests carried ut, and which will be described by mere way of unrestrictive example.

FIG. 1—Unwoven fabric at the initial stage.

Figure 2:
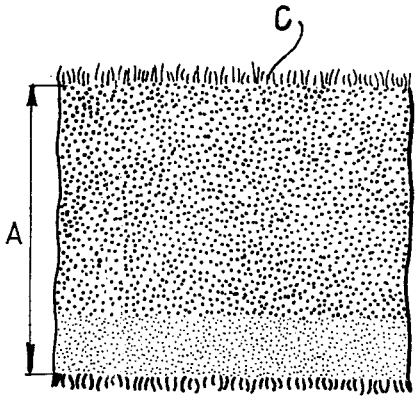

FIG. 2—Fabric treated by known technique.

Figure 3:
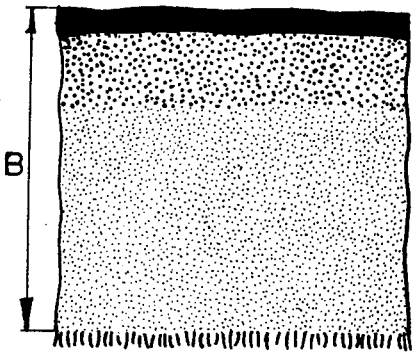

FIG. 3—Fabric treated according to the present invention.

In the figures of the accompanying drawing, the fabric has been shown by thin lines, and the resin by thicker lines.

FIG. 1 shows as unwoven fabric making up the base or support to be spread with emulsifying paste; it appears as a random agglomerate of fibers, having a certain thickness A, from the end faces of which the actual hairiness of the material exits.

EXAMPLE 1

On an unwoven fabric of 150 g/sq.m. a paste of butadieneacrylonitrile was spread, as thickened with methyl cellulose maintained in aqueous emulsion by surfactants. The paste thickness was 0.5 mm. It was found that in a short time the emulsion was absorbed by the fabric and the initial hairiness appeared again at the upper surface C, as shown in FIG. 2.

EXAMPLE 2

The process was carried out on an unwoven fabric of 150 g/sq.m., similar to that of Example 1. This fabric was impregnated by a conventional fourlard or squeezer in a solution comprising 30 parts of sodium chloride and 100 parts of water, then it was squeezed to retain 150% of moisture on the base of the fabric weight, that is 225 g/sq.m. of moisture, thus reaching a total weight of the wet fabric of 375 g/sq.m.

The fabric was then dried in a rameuse to appear as covered with fine salt crystals. A layer of 0.5 mm was then spread of a paste of butadiene-acrylonitrile, thickened with methyl cellulose and maintained in aqueous emulsion by surfactants, similar to that of Example 1. As soon as the emulsified latex contacted the sodium chloride, the emulsion was destabilized, coagulating on the fabric surface. This blocked any further penetration of the emulsion, which prevailingly remained above the surface C of the fabric, completely covering the piles, as clearly shown in FIG. 3, and increasing the fabric thickness from A to B, thus achieving also a softer and bulkier appearance.

The above example has been given by mere way of indication, since by the method according to the present invention of pretreating the unwoven fabric with a destabilizing agent, a large number of variants can be obtained. By adjusting the percentage of salt with respect to water, the squeezing degree (the foularded fabric may be also not dried at all), the type of electrolyte, the resin penetration can be adjusted to the desired thickness.

What is claimed is:

1. In a process for preventing surface-hairiness and surface exit of fibers from a non-woven fabric which comprises the step of applying to the surface of the fabric an emulsion latex of an acrylic or butadieneacrylonitrile resin the improvement which comprises the steps of (a) impregnating the non-woven fabric with a solution of an emulsion-destabilizing electrolyte salt, (b) spreading onto the surface of the impregnated fabric a layer of an emulsion latex of the resin, which layer is of sufficiently low thickness not to cause hardening or stiffening of the fabric.

2. The process as defined in claim 1 wherein the electrolyte salt is selected from the group consisting of sodium chloride, calcium chloride and aluminum sulphate.

3. The process as defined in claim 1 wherein step (a) further comprises reducing the moisture content of the impregnated fabric to such a residual moisture content that a residual amount of electrolyte salt is retained in the impregnated fabric which is sufficient to induce coagulation of the resin and partially prevent penetration of the resin into the fabric.

4. The process as defined in claim 1 which further comprises the step of sufficiently drying the impregnated fabric to obtain covering of the surface of the fabric with crystals of the electrolyte salt.

5. The process as defined in claim 1 wherein the layer of emulsion latex has a thickness of about 0.5 mm.

6. A soft non-woven fabric comprising a hair-free surface coated with a film of an acryl resin or butadieneacrylonitrile resin prepared by the method as defined in claim 4.

* * * * *